US005960973A

United States Patent [19]

Markson

[11] Patent Number: 5,960,973

[45] Date of Patent: Oct. 5, 1999

[54] BEVERAGE CONTAINER CLIP FOR SNACK PACKAGE

[75] Inventor: Richard Markson, Goshen, N.Y.

[73] Assignee: Markson Rosenthal & Company, Englewood Cliffs, N.J.

[21] Appl. No.: 08/874,094

[22] Filed: Jun. 12, 1997

[51] Int. Cl.[6] ..... B65D 23/12

[52] U.S. Cl. ..... 215/386; 40/310; 294/27.1

[58] Field of Search ..... 294/27.1, 31.2, 294/33, 145, 146; 40/310, 642.02, 658, 661.05, 661.12, 665; 215/386, 395, 396, 400; 220/694, 735, 737, 752, 758

[56] References Cited

U.S. PATENT DOCUMENTS

| | | | |
|---|---|---|---|
| 337,713 | 3/1886 | Snypp . | |
| 605,213 | 6/1898 | Weller . | |
| 775,988 | 11/1904 | Rinker | 40/310 |
| 899,217 | 9/1908 | Hetherington . | |
| 973,731 | 10/1910 | Watkins . | |
| 1,151,061 | 8/1915 | Stewart et al. . | |
| 1,225,069 | 5/1917 | Snyder | 294/33 |
| 1,337,816 | 4/1920 | Blackwell et al. | 40/310 |
| 1,776,085 | 9/1930 | Peterson | 40/310 |
| 1,910,013 | 5/1933 | Hansen | 215/386 X |
| 1,984,559 | 12/1934 | Wilcox . | |
| 2,058,809 | 10/1936 | Lewis | 40/310 |
| 2,250,666 | 7/1941 | Godefroy . | |
| 2,314,607 | 3/1943 | Clark | 215/386 |
| 2,340,719 | 2/1944 | Walter . | |
| 2,556,439 | 6/1951 | Pearson . | |
| 2,758,723 | 8/1956 | Morris et al. . | |
| 2,949,203 | 8/1960 | Berg . | |
| 4,208,819 | 6/1980 | Jones et al. | 40/310 |
| 4,378,831 | 4/1983 | Koltz | 150/39 |
| 4,635,291 | 1/1987 | Barton | 383/24 |
| 5,301,857 | 4/1994 | Green | 224/148 |
| 5,348,156 | 9/1994 | Maroszek et al. | 206/491 |
| 5,381,922 | 1/1995 | Gladman et al. | 220/481 |

*Primary Examiner*—Johnny D. Cherry
*Attorney, Agent, or Firm*—Abelman, Frayne & Schwab

[57] ABSTRACT

A carrier for holding an article, such as a package of snacks, is disclosed for use in conjunction with a beverage container. Several embodiments are shown for use in conjunction with either a bottle, can, or cup of the beverage. The article carrier includes a portion which is releasably secured to the beverage container, and a resilient clip which holds the package of snacks in association with the beverage container. The article carrier may be readily inserted onto, or removed from, the beverage container. Likewise, when the carrier is inserted onto the beverage container, the package of snacks may readily be added to or removed therefrom.

9 Claims, 4 Drawing Sheets

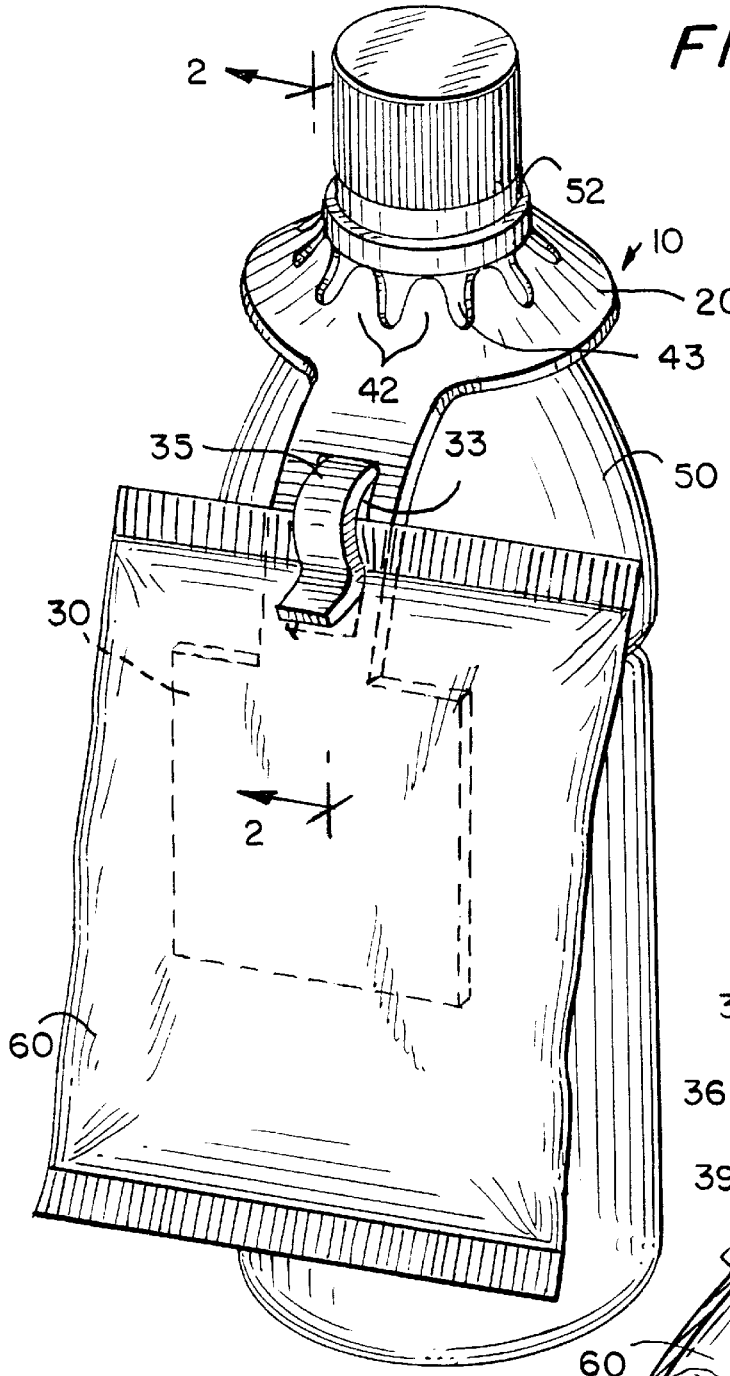
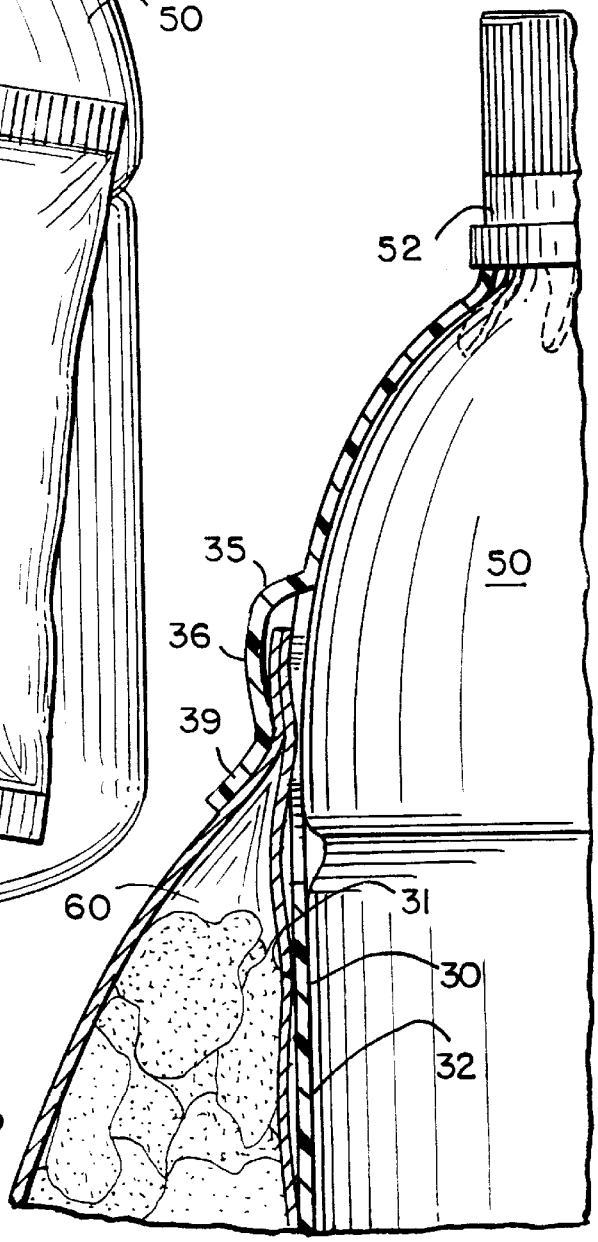
FIG. 2

BEVERAGE CONTAINER CLIP FOR SNACK PACKAGE

FIELD OF THE INVENTION

The present invention relates to a snack pack carrier clip for use in conjunction with a beverage container, such as a bottle, cup, or can. The carrier is releasably connected to the beverage container in a simple fashion and includes a clip for holding a package of snacks, such that the package of snacks can be presented to, and retained by, the consumer together with the beverage container.

BACKGROUND OF THE INVENTION

Packages of snacks, such as potato chips, corn chips, or pretzels are oftentimes consumed together with soft beverages. In some instances, in order to promote the sale of the beverage, marketing programs may be developed in which a package of snacks is given to the consumer upon purchase of the beverage. While various arrangements have previously been provided for combining the beverage container with another article, none provide a carrier element which may be simply attached to the beverage container, and includes a clip member for retaining the package of snacks in conjunction with the beverage container. Further, in addition to permitting the initial display of the package of snacks with the beverage container, it is often convenient to provide a beverage associated carrier for the package of snacks while the snacks are being consumed. This permits the consumer to readily hold both the beverage and the package of snacks in one hand.

It is also most desirable for the auxiliary carrier which retains the package of snacks in conjunction with the beverage container to be of simple designs and capable of low cost mass production. The carrier should preferably also be capable of easy, and rapid releasable attachment to, and removal from, the beverage container.

SUMMARY OF THE INVENTION

The present invention provides a carrier for holding an article, typically a package of snacks, in association with a beverage container. Various alternative embodiments are shown for releasably attaching the carrier to a bottle of beverage, can, or cup. The carrier of the present invention includes a clip member for retaining the snack package, as well as a securement means for releasably engaging the beverage container which is intended to carry the package of snacks.

Advantageously, the carrier may also include a display portion which can include textual material. For example, if the carrier is intended to provide the purchaser with a free package of snacks upon the purchase of the beverage, the display portion of the carrier can include a depiction of the snack, together with a statement that it is to be given to the consumer free of additional charge upon purchase of the beverage.

The carrier is preferably formed of a unitary molded plastic member, with the integrally contained clip being biased to tightly engage the snack pack by the inherent characteristics of the plastic material.

According to a first embodiment of my invention, which is intended to be used in conjunction with a beverage bottle, the carrier member includes an aperture of a size adapted to fit over the neck of the beverage container. The perimeter of the aperture is formed of a successive series of serrations separated by radial gaps. As the carrier is placed over the top of the bottle, the serrations will be moved out of their plane, to enlarge the aperture as it slides over the neck of the bottle. The inherent characteristics of the plastic material urge the serrations back towards their relaxed condition, whereby they securably, but releasably, retain the carrier on the neck of the beverage bottle.

According to another embodiments of my invention, which is intended to fit over a can or cup containing a beverage, the carrier is in the form of an openable collar having manually releasable elements at opposed ends. The manually releasable elements may be a tab, and complementary slot, or dimple like projections which are intended to enter and frictionally engage cooperative apertures.

A common advantage of all the embodiments is the provision of a clip for the snack package, their simplicity of operation, low cost construction, and ability to be readily inserted onto, or removed from, the beverage container.

Accordingly, it is an object to the present invention to provide a carrier for holding an article, such as a package of snacks, in association with a beverage container.

Another object of the present invention is to provide such carriers which may be readily used in conjunction with a bottle, can, or cup containing a beverage.

A further object of the present invention is to provide such a carrier which is integrally formed of a single piece of plastic, and includes a portion which may contain textual material related to the associated package of snacks.

Yet a further object of the present invention is to provide such a carrier which may be readily added to the beverage container at the retail location, in order for the retailer to participate in a marketing promotion in which the package of snacks is provided in conjunction with the purchase of the beverage.

These as well as other objects of the present invention will become apparent upon a review of the following drawings and detailed descriptions.

BRIEF DESCRIPTION OF THE DRAWINGS

FIG. 1 is a perspective view of a first embodiment of the present invention, in which one form of the carrier is utilized to contain a package of snacks in conjunction with a beverage bottle.

FIG. 2 is a cross-sectional view as shown by the arrows 2—2 of FIG. 1, and looking in the direction of the arrows.

DETAILED DESCRIPTION

Figure 3:
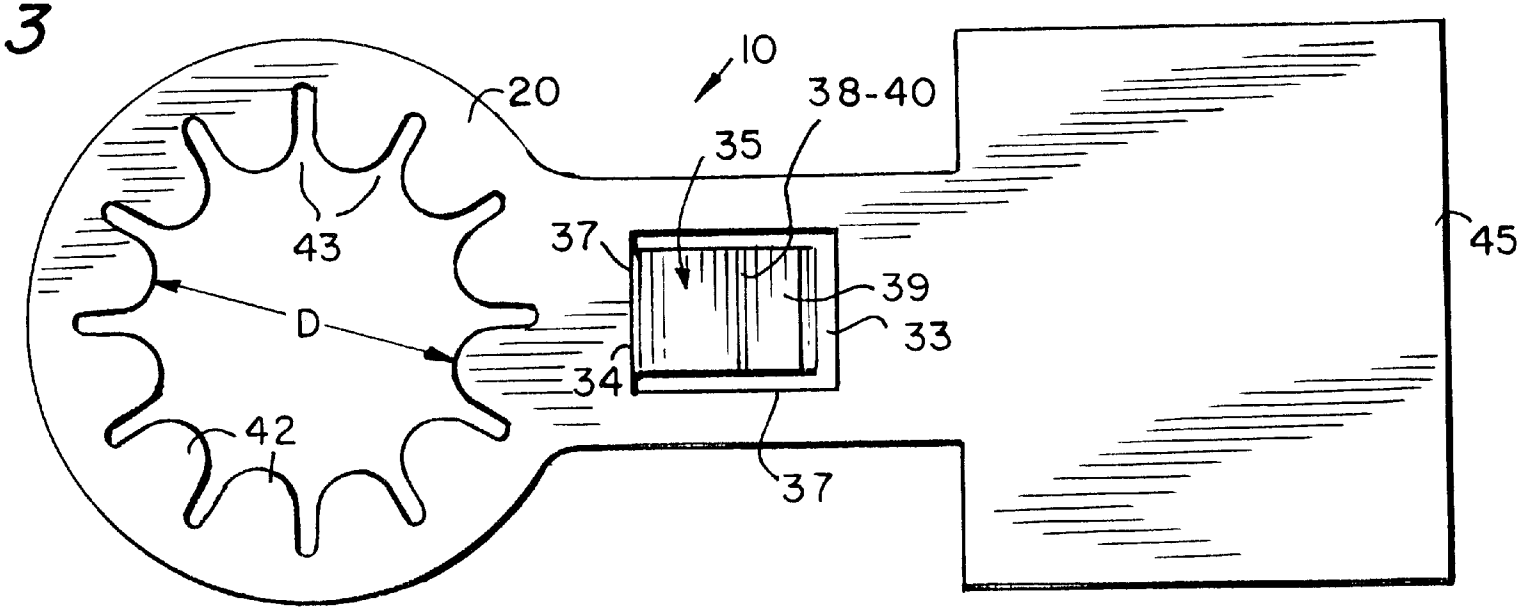
FIG. 3 is a top view of the carrier being utilized in FIGS. 1 and 2.
Figure 4:
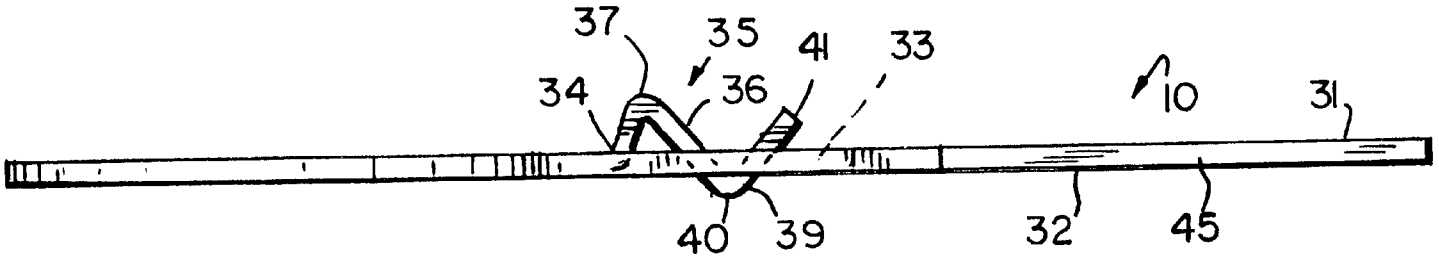
FIG. 4 is a front view of the carrier member shown in FIG. 3.

Reference is initially made to FIGS. 1–4 which shows one embodiment of the present invention, intended for use in conjunction with a beverage bottle 50. The beverage bottle 50, which may typically be formed of plastic or glass in the well-known manner, contains a neck 52 about which the carrier 10 of the present invention is to be releasably secured. The carrier 10 includes a first operative portion 20 and a second operative portion 30, which are integrally connected together as a unitary molded generally planar plastic member. The first operative portion 20 includes a releasable means for releasably engaging the neck portion 52 of the beverage container 50. In the embodiment as shown in FIGS. 1–4 the releasable securement means is in the form of a central aperture having a successive series of serrations 42 separated by radial gaps 43. During their relaxed condition, prior to insertion on the beverage container 50, this operative portion 20, including the serrations 42, will be in a generally planar disposition as shown in FIGS. 3 and 4. The diameter D of the opening formed by the internal extent of the serrations 42 will be slightly less than the neck 52 of the beverage container. Hence, as carrier 20 is moved downwardly over the top of the beverage container, to the position shown in FIGS. 1 and 2, the serrations 42 will translate upwardly as the aperture is enlarged, with the inherent resiliency of the plastic material retaining carrier 10 on the neck of the bottle. It should naturally be understood that the size of the securement means provided by serrations 42 is appropriately dimensioned to snugly, but releasably, fit over the neck 52 of the intended beverage container 50.

The second portion 30 of the carrier 10 includes a substantially planar region having opposed first forward surface 31 and rear surface 32, and an aperture 33 extending between these surfaces. The second operative portion may also preferably include an extension region 45 which may include advertising textual material related to the package of snack which may be intended to be carried by the carrier article 10. The aperture 33 includes a first side wall 34 and auxiliary side wall 37, which together form the perimeter of aperture 33. In this particular embodiment the auxiliary side walls are formed of three separate sections, such that aperture 33 is generally rectangular. However, it should be understood that other aperture shapes may be utilized.

A clip member 35 is provided in association within aperture 33. The clip member, as best shown in FIG. 4, is of a generally V-shape cross-section having a first leg 36 and a second leg 39. The first end 34 of the leg 36 is integrally connected to the aperture side wall 34. The opposed second end 38 of the first leg 36 meets the first end 40 of the second leg 39 at an angular juncture. The opposed second, or free, end 41 of the second leg 39 normally extends forward of the first forward surface 31 when the clip is in its relaxed condition, as shown in FIGS. 3 and 4. Both the first end 34 of the first leg, and free end 41 of the second leg extend forward of the front surface 31. The V juncture 38-40 will normally extend rearwardly of rear surface 32 when the clip 35 is in its relaxed condition.

In order to insert the package of snacks 60 into the clip, as shown in FIGS. 1 and 2, the clip member is pivoted forward about its connection 34, against the biasing means provided by the inherent plastic characteristics of the material forming carrier 10. Hence, this operative condition is characterized as the angular juncture 38-40 of the clip 35 engaging a portion of the package of snacks 60, with the biasing means provided by the plastic material urges the angular juncture 38-40 back towards its rear surface (to the relaxed condition as shown in FIGS. 3 and 4), with the clip 35 releasably retaining the package of snacks 60 in association with beverage container 50. It should be readily appreciated that the package of snacks 60 may be easily removed therefrom by downward movement, as shown in FIGS. 1 and 2, to release it from clip 35.

Figure 5:
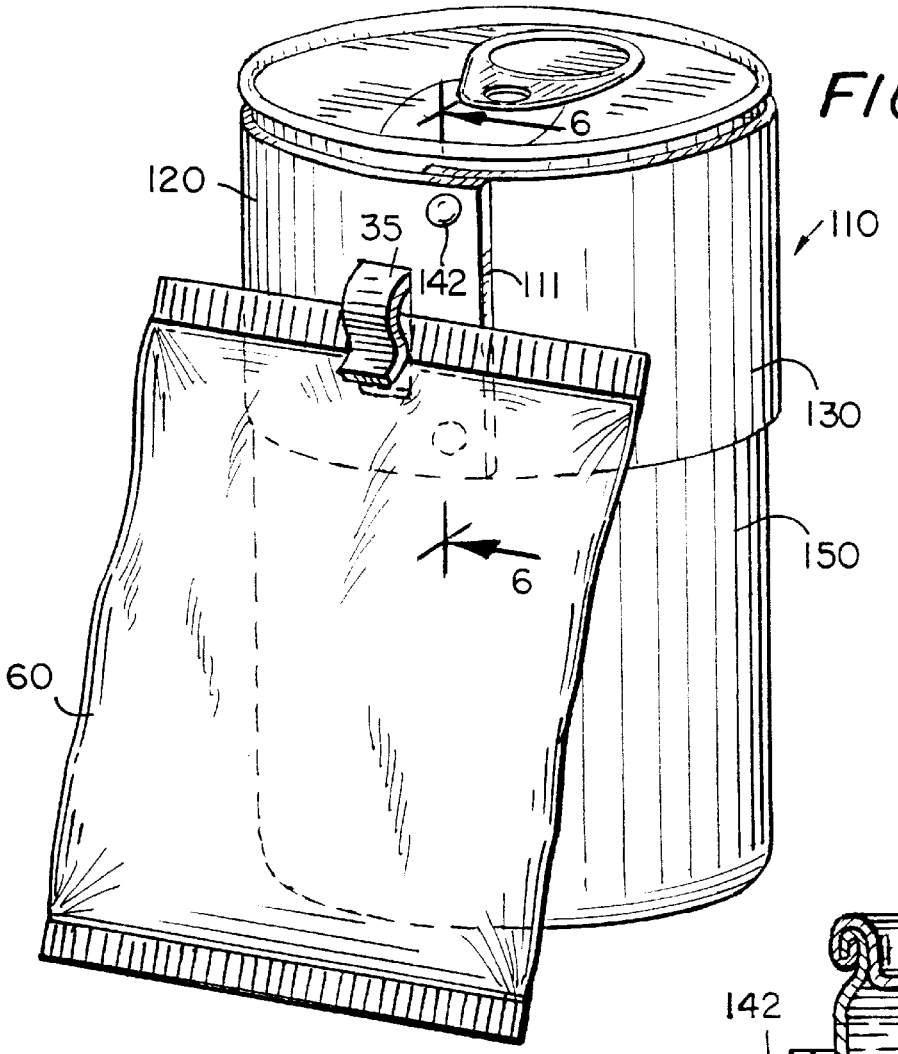
FIG. 5 is a view generally corresponding to FIG. 1, but showing another embodiment of the invention, utilized in conjunction with a can of beverage.
Figure 6:
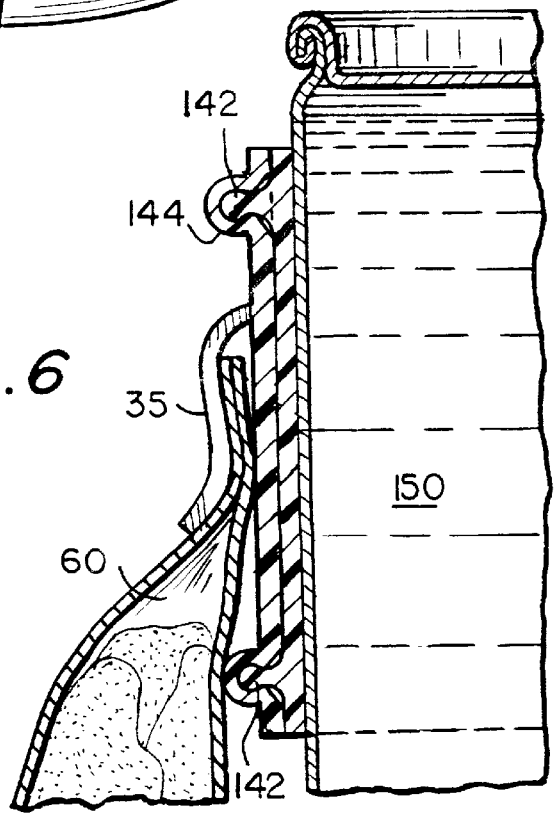
FIG. 6 is a cross-sectional view along the lines 6—6 as shown in FIG. 5 and looking in the direction of the arrows.

Reference is now made to FIGS. 5 and 6 which show a modification 110 of the present invention which is intended to be placed around a beverage can 150. Carrier 110 is in the form of an openable collar having ends 111 and 112. End 112 includes a pair of dimple projections 142 which are intended to frictionally engage apertures 144 at the opposed end 111. The distance between operating elements 142, 144 correspond to the circumference of can 150 and form a securement means for releasably engaging the beverage container 150. The clip 35 of this embodiment may be the same as shown in conjunction with FIGS. 1–4.

Figure 7:
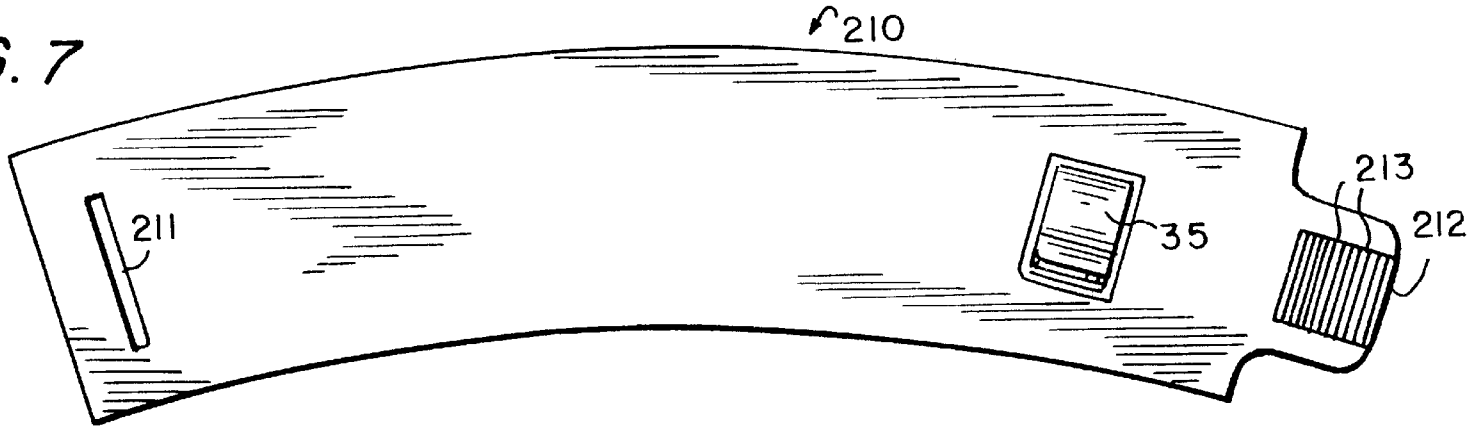
FIG. 7 is a top view of another embodiment of the present invention intended to be used in conjunction with a cup containing a beverage.
Figure 8:
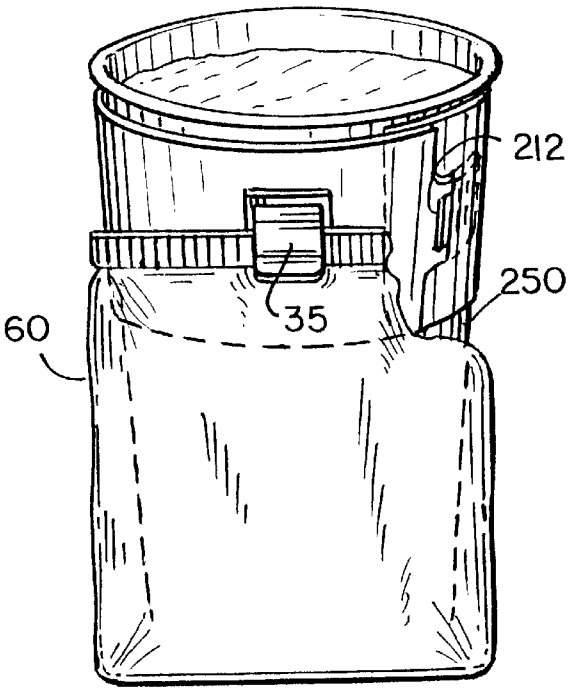
FIG. 8 is a perspective view showing the carrier of FIG. 7 in its operative use.

FIGS. 7 and 8 show still another embodiment of the carrier 210, which is intended to be placed about beverage cup 250. Article carrier 210, while generally in the form of an angular collar, will be tapered so as to appropriately engage the typical tapered periphery of the beverage cup 250. Carrier 210 includes a clip 35, generally corresponding to the prior embodiments. The releasable securement means is provided by a slot 211 at one end thereof, and a cooperating frictional tab 212 at the opposite end. Accordingly, to place article carrier 210 about the beverage cup 250, the tab 212 is inserted in slot 211 with one of a successive series of projections 213 engaging the sidewall of slot 211. Carrier 210 will now be releasably secured about cup 250, with clip 35 adapted to hold snack package 60.

While several embodiments of the present invention have been described in detail, various modifications, alterations, and changes may be made without departing from the spirit and scope of the present invention as defined in the following claims.

I claim:

1. A carrier for holding an article in association with a beverage container comprising:

first and second operative portions;

said first operative portion including securement means for releasably engaging a beverage container;

said second portion including a clip member having a relaxed first condition and an operative second condition, and biasing means for urging said clip member towards its first condition;

said second portion including a substantially planar region having opposed first forward and second rear surfaces, and an aperture extending between said first and second surfaces;

said aperture including a first sidewall, and auxiliary sidewalls extending from the opposed ends of said first sidewall, with said first and auxiliary sidewalls defining the perimeter of said aperture;

said clip member of a generally V-shaped cross-section, including first and second legs, each having first and second ends; the second end of said first leg meeting the first end of said second leg at an angular juncture, the first end of said first leg integrally connected to said first aperture sidewall, and extending forward of said first forward surface, the remaining portion of said first leg extending towards said second rear surface, with said angular juncture, when said clip member is in its said first relaxed condition, extending rearward of said second rear surface, and said second leg directed towards said first forward surface, with said second end of said second leg projecting forward of said first forward surface;

said clip member manually movable to its said second operative condition, in which said clip member is pivoted forward about its connection to said first sidewall, against said biasing means;

said second operative condition characterized as the angular juncture of said clip member adapted to engage a portion of an article to be held therewith, with said biasing means urging said angular juncture towards said second rear surface, to its first condition, while urging the portion of the article to be held into said aperture, such that the biasing means of said clip member releasably retains an article in association with a beverage container.

2. A carrier for holding an article in association with a beverage container, according to claim 1, wherein:

said first and second operative portions, including said clip member, are integrally formed of a unitary member.

3. A carrier for holding an article in association with a beverage container, according to claim 2, wherein said unitary member is molded plastic.

4. A carrier for holding an article in association with a beverage container, according to claim 1, wherein:

said securement means of said first operative portion includes an aperture of a size adapted to fit over the neck of a beverage container, the perimeter of said aperture of said first portion formed of a successive series of serrations, separated by radial gaps.

5. A carrier according to claim 4, wherein said carrier is formed of a single piece of molded plastic.

6. A carrier according to claim 1, wherein said first operative portion being in the form of an operable collar having first and second ends, said securement means including manually releasable first and second elements, respectively, at said first and second ends, said first operative portion having a first condition when said first and second elements are disconnected, and said first operative portion has a planar configuration, and a second operative condition when said first and second elements are connected and said first operative portion is characterized as forming a collar adapted to engage the outer periphery of a beverage cup or can.

7. A carrier according to claim 6, wherein one of said manually releasably first and second elements is a tab, and the other of said elements is a slot, adapted to retain said tab when said first operative portion forms a collar.

8. A carrier according to claim 6, wherein one of said manually releasably first and second elements includes apertures and the other of said elements includes projectors dimensioned to be frictionally retained within said apertures when said first operative portion forms a collar.

9. A carrier according to claim 6 wherein said carrier is formed of a single piece of molded plastic.

* * * * *